US005831654A

United States Patent [19]

Colombat

[11] Patent Number: 5,831,654

[45] Date of Patent: Nov. 3, 1998

[54] MODULATING DEVICE EQUIPPED WITH A LAST CHANCE FILTER FOR AN INK JET PRINTING HEAD

[75] Inventor: Thierry Colombat, Larvulte, France

[73] Assignee: Imaje S.A., Bourg les Valence Cedex, France

[21] Appl. No.: 593,864

[22] Filed: Jan. 30, 1996

[30] Foreign Application Priority Data

Jan. 31, 1995 [FR] France ..... 95 01121

[51] Int. Cl.[6] ..... B41J 2/19

[52] U.S. Cl. ..... 347/93

[58] Field of Search ..... 347/84, 85, 86, 347/87, 48, 67, 92, 93

[56] References Cited

U.S. PATENT DOCUMENTS

| | | | |
|---|---|---|---|
| 4,575,738 | 3/1986 | Shevfelt et al. | 347/94 |
| 4,864,329 | 9/1989 | Kneezel et al. . | |
| 5,063,393 | 11/1991 | Clark et al. . | |
| 5,426,459 | 6/1995 | Kaplinsky | 347/87 |
| 5,455,614 | 10/1995 | Rhodes | 347/74 |
| 5,594,483 | 1/1997 | Kaplinsky et al. | 347/87 |

FOREIGN PATENT DOCUMENTS

| | | |
|---|---|---|
| 603504 | 6/1994 | European Pat. Off. . |
| 2653063 | 4/1991 | France . |
| 3525810 | 1/1987 | Germany . |
| 63-064750 | 3/1988 | Japan . |

*Primary Examiner*—Adolf Berhane
*Attorney, Agent, or Firm*—Pearne, Gordon, McCoy & Granger LLP

[57] ABSTRACT

The invention relates to a modulating device for an ink jet printing head comprising a support (1) supporting a gun (3) equipped with a nozzle or discharging the ink jet, means for introducing pressurized ink (21), means for controlling the ink jet associated with the gun (3), ink filtering means, the gun defining a circuit permitting the circulation of the ink introduced into the assembly up to the nozzle. The filtering means (30) tangential filtering means, draining means (22) being provided for the discharge of the unfiltered ink.

12 Claims, 3 Drawing Sheets

MODULATING DEVICE EQUIPPED WITH A LAST CHANCE FILTER FOR AN INK JET PRINTING HEAD

The present invention relates to a modulating device equipped with a last chance filter for an ink jet printing head.

The various ink jet printing technologies use micro-orifices for calibrating the diameter of the jets or droplets. The standard dimensions are a diameter of approximately 20 to 80 um. The nozzles by which the said jets or droplets are discharged must remain free from impurities in order to ensure that a good printing quality is maintained. For this purpose ink jet printers and in particular continuous ink jet printers are equipped with filtering systems, which maintain the hydraulic circuits at a cleanness level compatible with the precision level of the components used for such technologies.

These filters must be located at particular points of the circuit. Firstly the filters are placed on the suction circuit. The suction pipes, generally equipped with strainers, must have a very low pressure loss and their design (size, filtration fineness) do not participate in maintaining the circuit cleanness level.

There are also filters at the outlet from the pump or pressure pipe. At these locations, it is necessary to have a fine filter for ensuring the cleanness of the circuit, because wear to various mobile components of the apparatus releases particles, which are spread throughout the circuit liquid. It is therefore very important to stop them before they pollute the complete installation. At this point the impurities are stopped by a filtering element, which must be periodically cleaned or replaced.

Finally, last chance filters are located at carefully chosen points. They retain contaminations having various origins such as fibres rejected by the main filter, pollutants enclosed between the main filter and the ink discharge nozzles at the time of assembly and the various contaminants which are introduced on opening the circuit during a maintenance operation. They ensure a reliable operation of the printer and in particular avoid any pollution of the nozzle. The rule is that the filtering element is positioned as close as possible to the nozzle. Last chance filters or LCF's are used in virtually all ink jet printers at points at different distances from the nozzles.

Maximum efficiency is obtained when the filter is located in the vicinity of the nozzles. This arrangement, like that described in U.S. Pat. No. 5,063,393, ensures that the nozzle is kept at an optimum cleanness level.

This is the choice made in most office printers, which provide droplets when required, so as to maintain the nozzles clean throughout the use of the printing head or during the production procedure, as indicated in U.S. Pat. No. 4,864,329.

Figure 1:
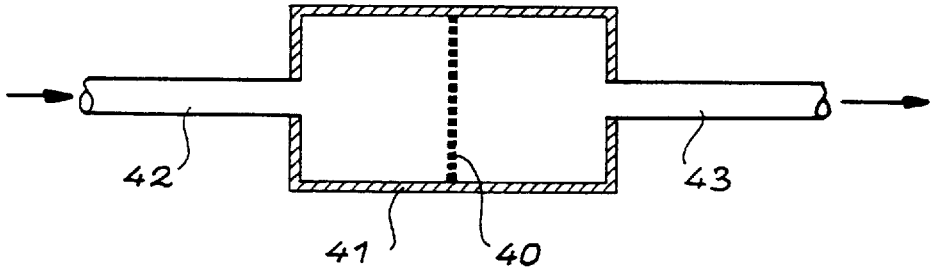

The last chance filters used on such prior art devices ensure a transverse filtration. This filtration process makes it necessary for the mixture constituting the ink to pass perpendicularly through the filter, as shown in FIG. 1. In FIG. 1, the transverse filter 40 is shown in the enclosure 41 located in the ink circuit between a supply pipe 42 and a discharge pipe 43. The pipe 42, which is connected to pressure, directs the mixture constituting the ink to the transverse filter 40. The pipe 43 passes the filtrate obtained to the ink discharge nozzle. The solid phase of this mixture is progressively deposited, so that after a certain time the filter 40 becomes clogged. This clogging problem also occurs when pigment ink is used. This situation increases the pressure loss in the duct and pipe on changing the filter or on subjecting the latter to a regeneration cycle.

In order to obviate this problem, the present invention proposes a modulating device for an ink jet printing head using the tangential filtration principle. The application of this principle makes it possible, at the time of opening the draining system, to keep the ink jet operating whilst allowing the fluid to circulate at a high flow rate parallel to the filtering surface and in particular against the outer wall of the filter. This refreshing phase scavenging movement permanently washes the filter surface and prevents particle deposition.

Thus, the invention relates to a modulating device for an ink jet printing head comprising a support, which supports a gun equipped with a nozzle for discharging the ink jet, pressurized ink introduction means, means for controlling the ink jet associated with the gun and ink filtering means, the gun defining a circuit permitting the circulation of the ink introduced into the assembly up to the nozzle, characterized in that the filtering means are tangential filtering means, drainage means being provided for discharging the unfiltered ink.

The gun can comprise a body engaged tightly in the support, the space between the gun body and the support forming a chamber, the filtering means subdividing the chamber into an upstream part to which lead the ink introduction means and from which emanate the drainage means, and a downstream part communicating with the ink circuit of the gun.

The modulating device according to the invention is preferably of a generally cylindrical shape about an axis, which is the axis of the ink jet, the filtering means called the crosspiece also being tubular.

The ink jet of the gun is then advantageously constituted by a channel made in the gun body.

The gun body can be engaged tightly in the support by means of two joints, which can be expanded under the effect of a pressure and which are installed around the body and located at each end of said crosspiece.

The gun, crosspiece, two expansible joints and an assembly nut and optionally the ink jet control means can be assembled separately from the support in order to form a one-piece assembly.

The invention is described in greater detail hereinafter relative to a nonlimitative embodiment and with reference to the attached drawings, wherein show:

FIG. 1 Diagrammatically a last chance filter for a modulating device for an ink jet printing head according to the prior art.

Figure 2:
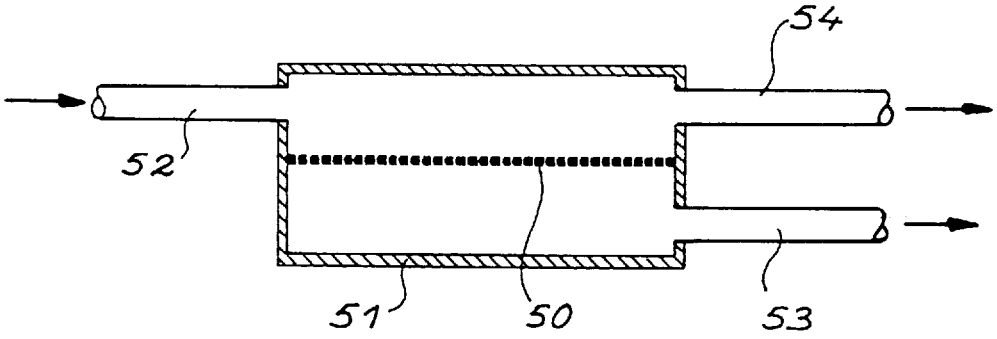

FIG. 2 Diagrammatically a last chance filter for a modulating device for an ink jet printing head according to the invention.

Figure 3:
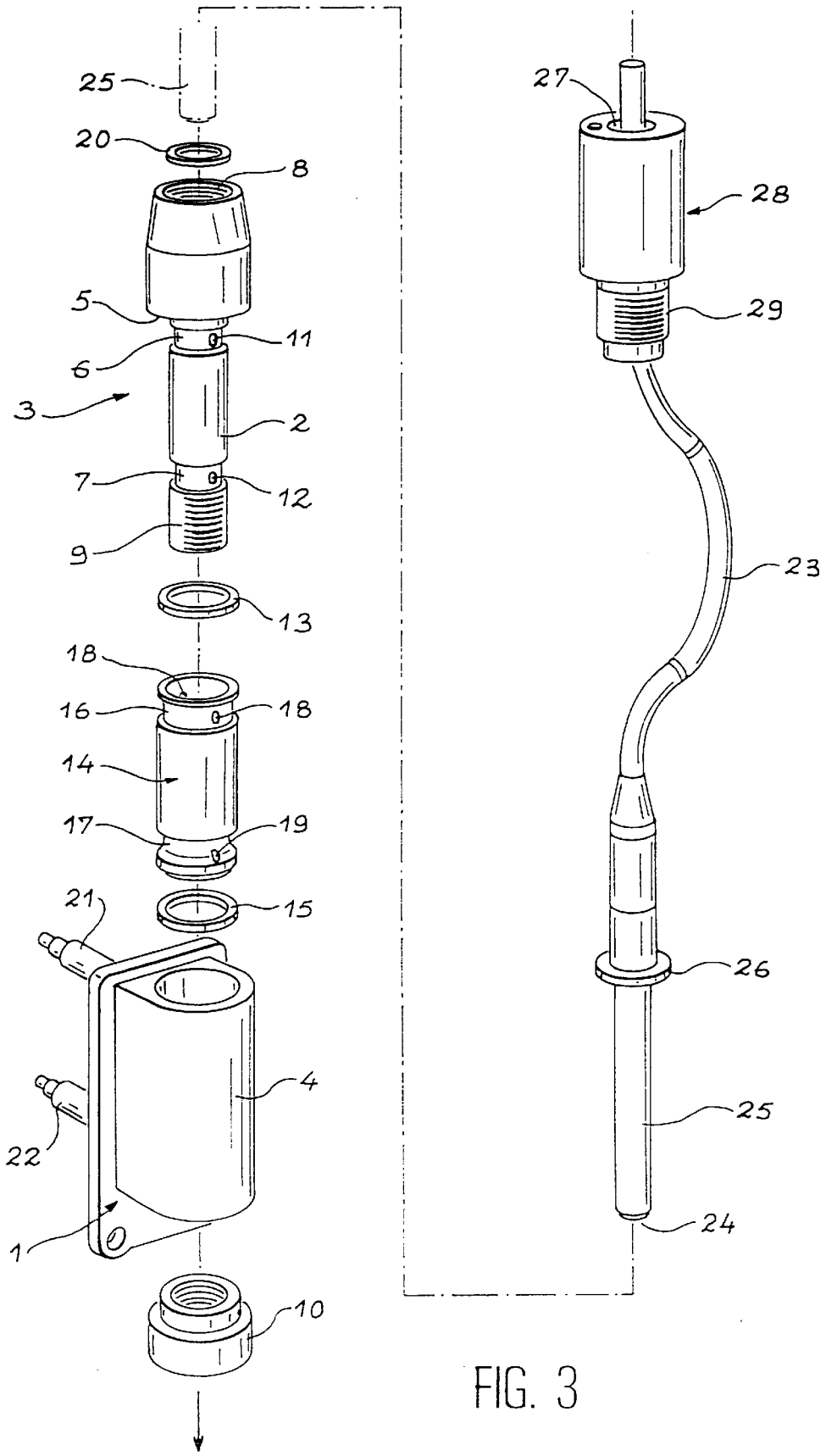

FIG. 3 An exploded view of a modulating device for a prior art ink jet printing head.

Figure 4:
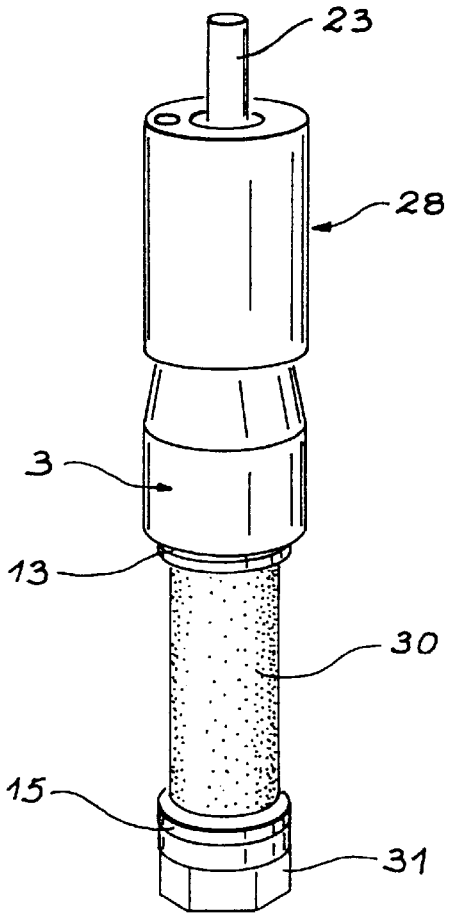
Figure 4:
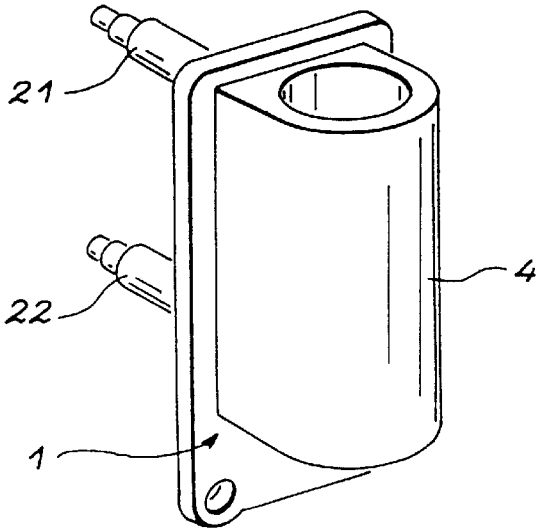

FIG. 4 The modulating device of FIG. 3 modified according to the invention.

The principle of the invention is illustrated by FIG. 2, which shows a filter 50 located in an enclosure 51 tangentially to the ink flow. The mixture constituting the-ink is introduced into the enclosure 51 by the pipe 52, which is connected to pressure. Part of this ink mixture is filtered by the tangential filter 50 in order to form the filtrate, which is passed by means of the pipe 53 to the ink discharge nozzle. The retentate is discharged by the pipe 54 to the drainage system.

The solution proposed by the invention will now be applied to the modulating device of FR-A-2 653 063. This device is shown in exploded view form in FIG. 3, the elements shown in the right-hand part normally being located in the extension of the upper, left-hand part.

The device has a support 1, which is to be fixed to the mechanical structure of the printing head (cf. FIG. 1 of FR-A-2 653 063). The body 1 has a tubular part 4, whose axis coincides with the ink jet axis. In said tubular part 4 is housed the body 2 of the gun 3, which is a generally cylindrical part, whose axis of revolution coincides with the axis of the tubular part 4. The gun 3 has a through axially hole 8.

The body 2 forms the lower part of the gun 3. A shoulder 5 forms the separation between the body 2 and the upper part of the gun 3. The body 2 has an upper groove 6 close to the shoulder 5 and a lower groove 7. The lower end 9 of the body 2 is threaded in order to receive the nut 10. Radial holes 11, 12 respectively made in the grooves 6 and 7 ensure the communication between the axial hole 8 and the grooves 6 and 7.

Before engaging the gun body 2 in the tubular part 4 of the support 1, onto the body 2 are successively threaded the ring-shaped joint 13, the tubular crosspiece 14 and the ring-shaped joint 15. The mean diameters of the joints 13 and 15 correspond to the diameter of the crosspiece 14, so that the joint 13, crosspiece 14 and joint 15 form a stack.

When the body 2 of the gun 3, equipped with the joint 13, the crosspiece 14 and the joint 15 has been introduced into the tubular part 4, the nut 10 is screwed onto the end 9 of the body 2 through the lower orifice of the tubular part 4. The joint 13 abuts against the gun shoulder 5 and the pressure exerted by the nut 10 during screwing on the joint 15 has repercussions on the joint 13-via the crosspiece 14. Joints 13 and 15 are expansible under the effect of the pressure. The locking of the nut 10 leads to the joints 13 and 15 being applied to the inner wall of the tubular part 4, thus ensuring both sealing at the joints and the fixing of the gun 3 to the support 1. It is pointed out that the nut 10 does not bear on the tubular part 4 of the support, its action only being exerted on the stack formed by the joint 13, crosspiece 14 and joint 15.

The crosspiece 14 has an upper groove 16 and a lower groove 17. Holes 18 and 19 are made radially and respectively in the grooves 16 and 17. On assembly, the grooves 16 and 17 of the crosspiece 14 face the respective grooves 6 and 7 of the body 2.

The support 4 has a pressurized ink introduction connector 21 in the tubular part 4 and a connector 22 permitting the drainage of said tubular part. These connectors 21 and 22 issue in the vicinity of the grooves 16 and 17 of the crosspiece 14.

The resonator 25, making it possible to stimulate the ink jet, is introduced by its end 24 into the gun 3 by means of the upper orifice of the hole 8, through the joint 20. The other end of the resonator is extended by an electric cable 23 to an external control member. The cable 23 passes into the axial hole 27 of the flange 28.

The resonator is fixed in the gun in the following way. The resonator 25 equipped with the joint 20 is introduced into the hole 8 until the lower face of the joint 20 abuts against a shoulder in said hole 8. The collar 26 then abuts on the upper face of the joint 20. The flange is slid along the cable 23 and its lower, threaded portion 29 is screwed into the upper, tapped portion of the hole 8 until the seal 20 is subject to pressure.

The device operates as follows. The pressurized ink injected by the connector 21 wets the outside of the crosspiece 14 and penetrates the interior through holes 18 in order to reach the outer part of the gun body 2. The ink passes into the holes 11 of the groove 6, penetrates the interior of the gun whilst wetting the resonator 25 and is passed to the end 9 of the gun, which is terminated by a-washer (not visible in FIG. 1) having an axial hole serving as an ink discharge nozzle. The device is drained or cleaned by ink return, by means of the holes 12, into the tubular space between the body 2 and the crosspiece 14 and then, by means of the crosspiece holes 19, into the tubular space between the crosspiece 14 and the tubular part of the support. The ink is then discharged through the connector 22.

The ink jet stimulated by the resonator 25 then passes along the axis of the device, as indicated by the arrow under the nut 10. Lateral holes provided in the nut 10, the gun 3 and the flange 28 permit settings to be made in order to ensure a good alignment of the ink jet. These settings are explained in FR-A-2 653 063.

In FIG. 4, illustrating the invention, the same references as in FIG. 3 designate the same elements. The device is shown partly assembled. The crosspiece of FIG. 3 has been replaced by a filtering crosspiece 30 serving both as a crosspiece and as a last chance filter. This filtering crosspiece ensures a transverse filtering of the ink and forms a last chance filter for the device. This filter is also permanently washed by the arriving ink.

Such a solution can be adapted to different arrangements with a tubular or planar filter using different media such as wire gauzes, synthetic cloths and membranes.

The solution proposed by FIG. 4 has a nut 31 different from that of FIG. 3.

The nut, which previously had (cf. FIG. 3) a shoulder with holes for locking purposes, is modified in such a way that its external diameter is aligned with that of the crosspiece and it is manipulated on the basis of a hexagonal shape.

It is possible to assemble beforehand the one-piece assembly constituted by the gun, the various joints, the filtering crosspiece, the resonator, the flange and the nut. This one-piece assembly is then slid into the support 1, where it is tightly fixed. This arrangement is particularly advantageous, because it permits a clean assembly in the factory, facilitates installation on the printing head and permits the starting up of the jet without any instability linked with a possible pollution of the nozzle.

I claim:

1. Modulating device for an ink jet printing head comprising a support, which supports a gun equipped with a nozzle for discharging the ink jet, pressurized ink introduction means, means for controlling the ink jet associated with the gun and ink filtering means, the gun defining a circuit permitting the circulation of the ink introduced into the assembly up to the nozzle, wherein the filtering means are tangential filtering means, drainage means being provided for discharging the unfiltered ink.

2. Modulating device according to claim 1, wherein the gun comprises a body, which is engaged tightly-in the support, the space between the gun body and the support constituting a chamber, the filtering means subdividing the chamber into an upstream part to which lead the ink introduction means and from which pass the drainage means, and a downstream part communicating with the ink circuit of the gun.

3. Modulating device according to claim 2 having a generally cylindrical shape about an axis, which is the ink jet axis, the filtering means, called the crosspiece, being tubular.

4. Modulating device according to claim 3, wherein the ink circuit of the gun is constituted by a channel made in the gun body.

5. Modulating device according to claim 4, wherein the ink jet stimulating means comprise a resonator introduced into the channel of the gun.

6. Modulating device according to claim 4, wherein the gun body is engaged tightly in the support by means of two expansible joints under the effect of pressure, installed around the body and located at each end of the crosspiece.

7. Modulating device according to claim 6, wherein the gun body has a first, outer groove in the vicinity of the ink introduction means and a second, outer groove in the vicinity of the drainage means, the grooves communicating with the channel of the body.

8. Modulating device according to claim 6 having a nut which, on being screwed onto the gun, exerts a pressure on the expansible joints by means of the crosspiece and a joint translation stoppage abutment, the expansion of the joints ensuring sealing and fixing of the gun in the support.

9. Modulating device according to claim 8, wherein with the nut screwed on the end of the gun body, the external diameter of the nut is chosen so as to be able to freely engage in the support, which has an access orifice for screwing down the nut.

10. Modulating device according to one of the claims 8 or 9, wherein the gun, crosspiece, two expansible joints and nut constitute a one-piece assembly ready for installation on the support, said assembly being obtained by assembling the components beforehand.

11. Modulating device according to claim 10, wherein the one-piece assembly also incorporates ink jet stimulating means rendered integral with the assembly by fixing means.

12. Modulating device according to claim 1, wherein the gun and the filtering means form part of a one-piece assembly ready for installation on the support and obtained by prior assembly.

* * * * *